US006700598B1

(12) United States Patent
Hull

(10) Patent No.: US 6,700,598 B1
(45) Date of Patent: Mar. 2, 2004

(54) DIGITAL IMAGING SYSTEM EMPLOYING NON-COHERENT LIGHT SOURCE

(75) Inventor: Frank A. Hull, Mound, MN (US)

(73) Assignee: Cortron Corporation, Minneapolis, MN (US)

( * ) Notice: Subject to any disclaimer, the term of this patent is extended or adjusted under 35 U.S.C. 154(b) by 0 days.

(21) Appl. No.: 09/843,526

(22) Filed: Apr. 25, 2001

Related U.S. Application Data

(60) Provisional application No. 60/199,532, filed on Apr. 25, 2000.

(51) Int. Cl.[7] ..... B41J 2/45; B41J 2/47

(52) U.S. Cl. ..... 347/238; 347/239; 347/255

(58) Field of Search ..... 347/236, 238, 347/239, 246, 255, 131, 134; 313/570; 378/34; 399/2

(56) References Cited

U.S. PATENT DOCUMENTS

| | | | | |
|---|---|---|---|---|
| 3,980,476 A | | 9/1976 | Wysocki | 430/21 |
| 4,380,373 A | | 4/1983 | Sprague | 359/318 |
| 4,389,659 A | | 6/1983 | Sprague | 347/136 |
| 4,675,702 A | | 6/1987 | Gerber | 347/233 |
| 4,844,577 A | | 7/1989 | Ninnis et al. | 385/9 |
| 5,028,939 A | | 7/1991 | Hornbeck et al. | 347/131 |
| 5,033,814 A | | 7/1991 | Brown et al. | 385/16 |
| 5,049,901 A | | 9/1991 | Gelbart | 347/239 |
| 5,175,755 A | * | 12/1992 | Kumakhov | 378/34 |
| 5,317,446 A | | 5/1994 | Mir et al. | 359/296 |
| 5,317,659 A | | 5/1994 | Lee | 385/22 |
| 5,438,873 A | | 8/1995 | Wlodarczyk et al. | 73/705 |
| 5,459,505 A | | 10/1995 | Ballegaard et al. | 347/260 |
| 5,517,347 A | | 5/1996 | Sampsell | 359/224 |
| 5,579,240 A | | 11/1996 | Buus | 355/67 |
| 5,781,341 A | | 7/1998 | Lee | 359/578 |
| 5,844,588 A | | 12/1998 | Anderson | 347/135 |
| 5,862,275 A | | 1/1999 | Takeuchi et al. | 385/19 |
| 5,917,986 A | | 6/1999 | Vanderreydt et al. | 385/147 |
| 5,930,027 A | | 7/1999 | Mentzer et al. | 359/298 |
| 6,081,316 A | | 6/2000 | Okamura et al. | 355/18 |
| 6,114,807 A | * | 9/2000 | Kavanagh | 313/570 |
| 6,201,559 B1 | * | 3/2001 | Wada et al. | 347/236 |

FOREIGN PATENT DOCUMENTS

| | | | | |
|---|---|---|---|---|
| JP | 2-96463 | * | 4/1990 | H04N/1/04 |

OTHER PUBLICATIONS

Vanderreydt, J.P., "Large–Area Fiber–Optic Display Using Piezoelectric Shutters", *SID 95 Digest*, pp 311–314, 1995.

Li, Jun et al., "Electrooptic Wafer Beam Deflector in LiTaO3", *IEEE Photonics Technology Letters*, vol. 8, No. 11, pp 1486–1488, Nov. 1996.

Chiu, Yi, "Shape–Optimized Electrooptic Beam Scanners: Analysis, Design, and Simulation", *Journal of Lightwave Technology*, vol. 17, No. 1, pp 108–114, Jan. 1999.

* cited by examiner

*Primary Examiner*—Hai Pham
(74) *Attorney, Agent, or Firm*—Kinney & Lange, P.A.

(57) ABSTRACT

An apparatus utilizing non-coherent light digitally exposes a light-sensitive medium. The apparatus includes a non-coherent light source such as a wall stabilized plasma-filled capillary lamp, a reflector positioned proximate the non-coherent light source to reflect actinic radiation, a modulator positioned to selectively transmit the reflected actinic radiation and the light sensitive material positioned proximate the modulator to receive modulated actinic radiation.

30 Claims, 7 Drawing Sheets

DIGITAL IMAGING SYSTEM EMPLOYING NON-COHERENT LIGHT SOURCE

CROSS-REFERENCE TO RELATED APPLICATIONS

This application claims the benefit of Provisional Application No. 60/199,531 filed Apr. 25, 2000 for "Digital Imaging System Employing Non-Coherent Light Source" by F. Hull.

INCORPORATION BY REFERENCE

The aforementioned Provisional Application No. 60/199,532, U.S. application Ser. No. 09/505,017 for "Digital Imaging System Utilizing Modulated Broadband Light" filed Feb. 16, 2000 by F. Hull, and U.S. application Ser. No. 09/484,405 for "Digital Imaging System Utilizing Modulated Broadband Light" filed Jan. 14, 2000 by F. Hull are hereby incorporated by reference in their entirety and made a part of this application.

BACKGROUND OF THE INVENTION

The present invention relates to a high resolution digital imaging device employing a non-coherent light source that is selectively modulated to create the individual pixels of the image to be recorded. The invention is particularly useful in the graphic arts industry for exposing a variety of light-sensitizable media such as printing plates, proofing materials, relief plates and the like.

In the graphic arts industry, high resolution images are formed by exposing a light-sensitizable medium such as a printing plate with an appropriate light pattern. Traditionally, the printing plates were covered with a patterned film and exposed by broadband light to create the desired image on the plate. The broadband light was utilized at low energy levels, such that the film intermediary was required to properly expose the plate. In this use the low level of energy strikes the entire area to be exposed for a fairly long time, 10 seconds to as much as 20 minutes, depending on the consumable.

More recently, methods that do not utilize film intermediaries have been developed. Such methods include utilizing digital laser imaging at much higher levels of energy. However, such laser devices employed with these methods are quite expensive due to the relatively high costs of lasers and of the special plates that operate with the laser imaging device, and the laser devices also operate at relatively low speeds. Attempts have also been made to implement printing devices capable of utilizing a broadband, non-coherent light source, with addressing of image pixels being accomplished by reflective spatial light modulators.

These devices have proved to be impracticable, in part due to the inability of the reflective spatial light modulators to withstand the required exposure to intense ultra-violet light, which rapidly breaks down the movable micro-mirrors of ferro-electric liquid of the modulators. The alternative is to employ a very fast and expensive media. There are a few varieties of modulators such as prism-type electro-optics, piezoelectric Kerr-cell and bi-morph piezoelectric combs that are capable of withstanding such energy. These modulators, however, are all based upon a line array as opposed to an area array. There are several patents, including U.S. Pat. No. 5,033,814 issued to Brown et al., that suggest the concept of using a DC short arc lamp, condensers and reflectors to illuminate a round bundle of fibers at one end, while the opposite end of the bundle of fibers are assembled in a straight line. There are several problems with this approach including light transmission efficiency, polishing of fibers and expense.

Additionally, the ultra-violet (actinic) radiation required to expose such graphic arts media has a wavelength in the range of 330 to 430 nano-meters, which further increases costs and reduces the overall efficiency when compared to the Brown et al. patent, which was not designed to deliver large amounts of power at these wavelengths.

It would therefore be a significant improvement in the art to provide a durable, high resolution digital imaging system utilizing a non-coherent light source, operable at high speeds with conventional printing plates. The requirements of such a light would include but not be limited to, the following: a stable illumination without an appreciable flicker; a nearly instant "on", minimizing a warm-up period; a high ratio of actinic radiation to total radiation; minimizing a "ripple" component, caused by an AC power supply, interfering with modulation; evenly distributing illumination intensity over a specific area; providing an output spot nearly matching a modulator shape to eliminate the need for large fiber arrays; and providing a smaller and more uniform divergence angle in the illumination.

DETAILED DESCRIPTION

Figure 1:
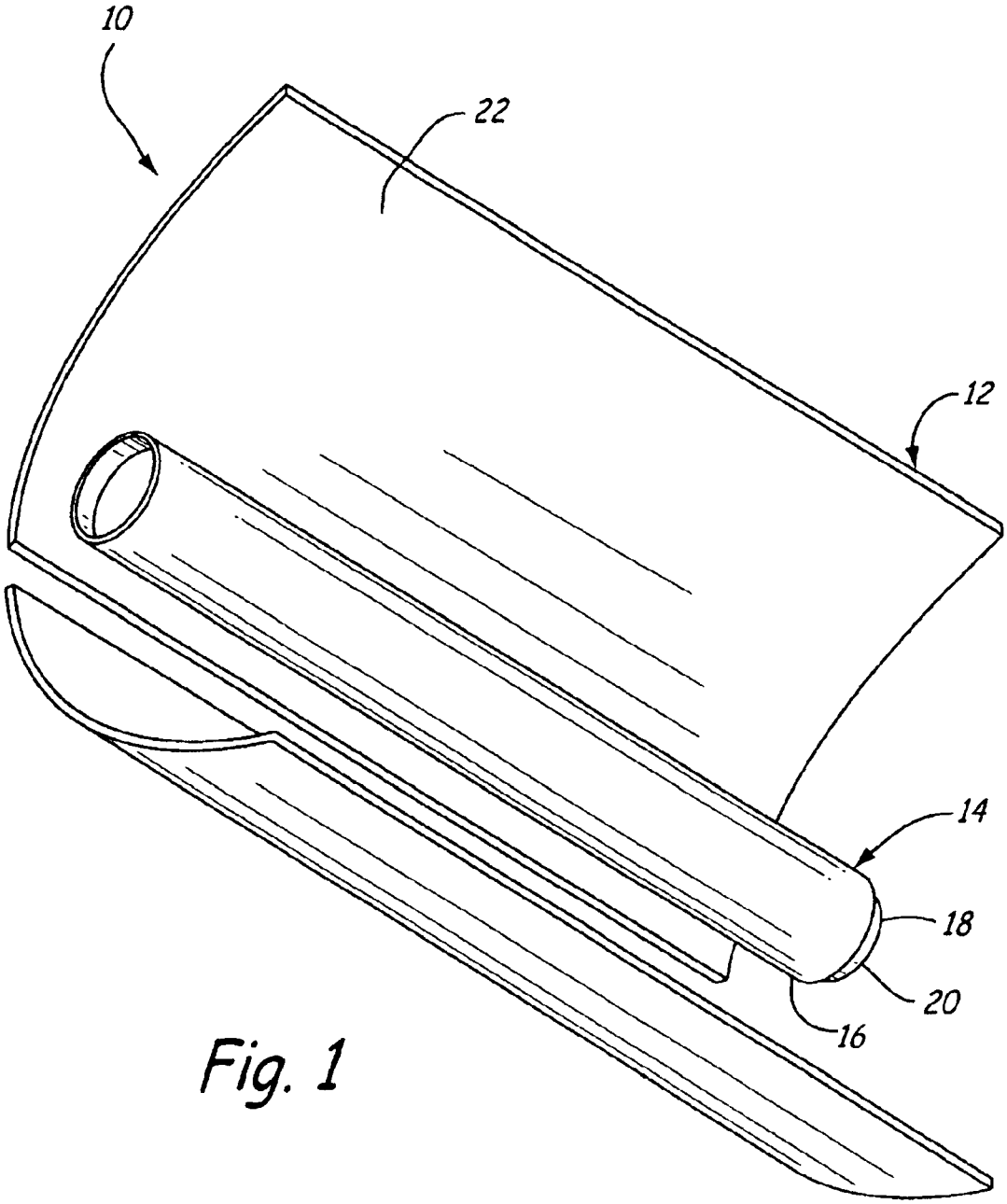
FIG. 1 is a perspective view of a light source assembly of the present invention.

A non-coherent light source assembly of the present invention is indicated generally at 10 in FIG. 1. The light source assembly 10 comprises a glass ellipsoidal trough reflector 12 and a light source 14. Light source 14 comprises a non-coherent, ultra-violet transmissive fused silica cooling tube 16, capillary lamp 18, and mercury plasma 20 within capillary lamp 18. Each component of light source 14 is coaxially aligned and positioned proximate to glass ellipsoidal trough reflector 12 or similar apparatus for focusing non-coherent light in a selected direction. Preferably, an inside surface 22 of glass ellipsoidal trough reflector 12 is coated with an ultra-violet reflective dichroic coating, which reflects only actinic radiation. Thus, only actinic radiation is focused by glass ellipsoidal trough reflector 12, while unwanted white light and infrared radiation pass therethrough.

Figure 2:
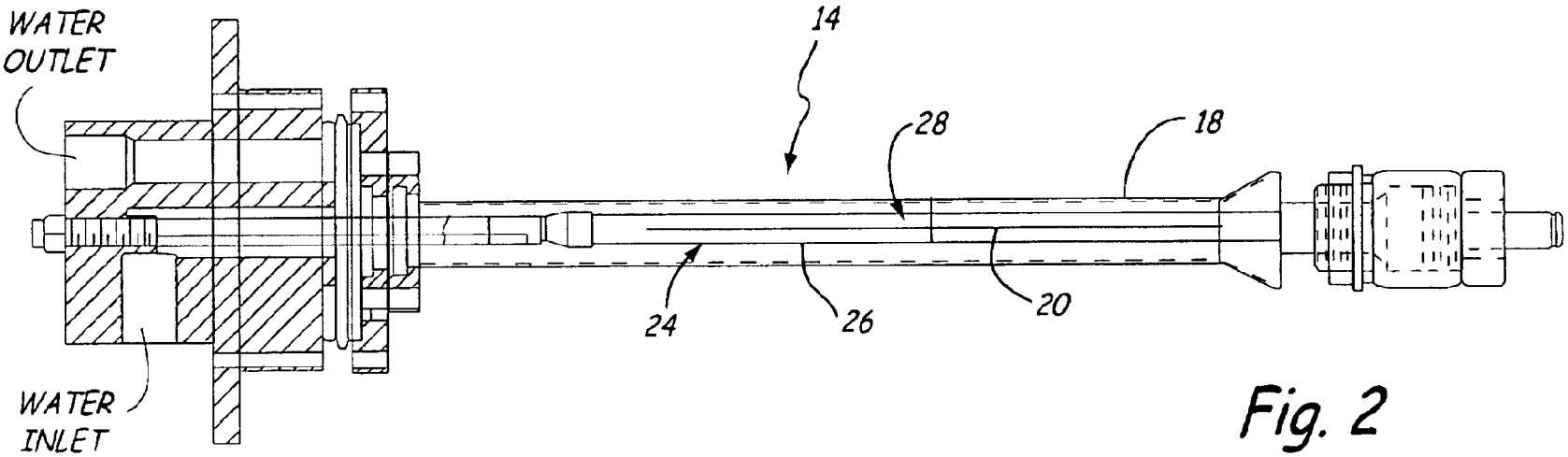
FIG. 2 is a diagram of a non-coherent light source of the present invention.

FIG. 2 is a diagram illustrating the construction of an exemplary non-coherent light source 14 in more detail. Capillary lamp 18 is a 5000 Watt high pressure plasma capillary light source. Capillary lamp 18 is water-cooled, as is known in the art, with a water inlet and water outlet provided as shown in FIG. 2. However, it would also be within the scope of the present invention to air-cool capillary lamp 18. The dimension of the capillary lamp 18 is approximately 150 mm in length and 7 mm in diameter. Plasma capillary 20 within capillary lamp 18 is about 125 mm in length and 0.1 mm in diameter. This style of illumination is referred to as a wall stabilized arc. Stabilization is created by the extremely high temperature gradient between capillary wall 24 on outside surface 26 and the plasma within a middle portion 28 of capillary 20.

In contrast to spherical short arc lamps used in the prior art, the plasma is only a few millimeters in length, primarily spherical and is stabilized by cathodes. The wall stabilized plasma does not emit electrons from the cathodes as the short arc lamp but rather from a mercury pool located at each end. The capillary 20 can be run on high voltage, low current DC to avoid the severe ignition electro-motive pulse of short arc lamps and to remove an AC ripple. High accuracy in the trough reflector 12 combined with a small diameter make it possible to achieve a very tight focus line of approximately about 2 mm at a focal point or fold mirror position.

The actinic output (330–430 nm wavelength) of light source 14 is approximately 7% of the total power of the capillary lamp 18, or about 350 watts. The combination of mirrored cooling tube 16 and ellipsoidal trough reflector 12 collects nearly 70% of the output power and focuses the power within a tight 2 mm by 125 mm stripe of light. This configuration provides a total energy density (power divided by stripe area) in the actinic 330–430 nm wavelength of about 1 $W/mm^2$.

Figure 3:
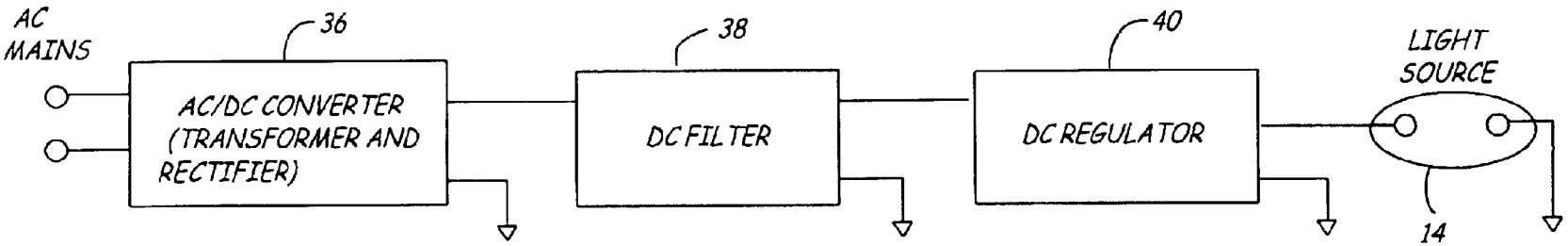
FIG. 3 is a block diagram of exemplary circuitry for driving the non-coherent light source of the present invention.

FIG. 3 is a block diagram of exemplary circuitry for driving non-coherent light source 14. Power, preferably in the form of an AC 220 volt, 40 ampere signal, is supplied by AC mains, and input to AC/DC converter 36. AC/DC converter 36 rectifies the AC input signal and transforms the signal to the appropriate level for operating light source 14. The transformed and rectified signal is passed on to DC filter 38 and DC regulator 40, which operate to smooth the signal from a rectified sine wave to a more nearly constant DC value. This operation reduces any "ripple" effects or resultant beat frequency patterns in the signal, which would otherwise experience fluctuations that could affect the performance of the light source, which desirably produces an output having a constant intensity based on a constant input signal thereto.

Figure 4:
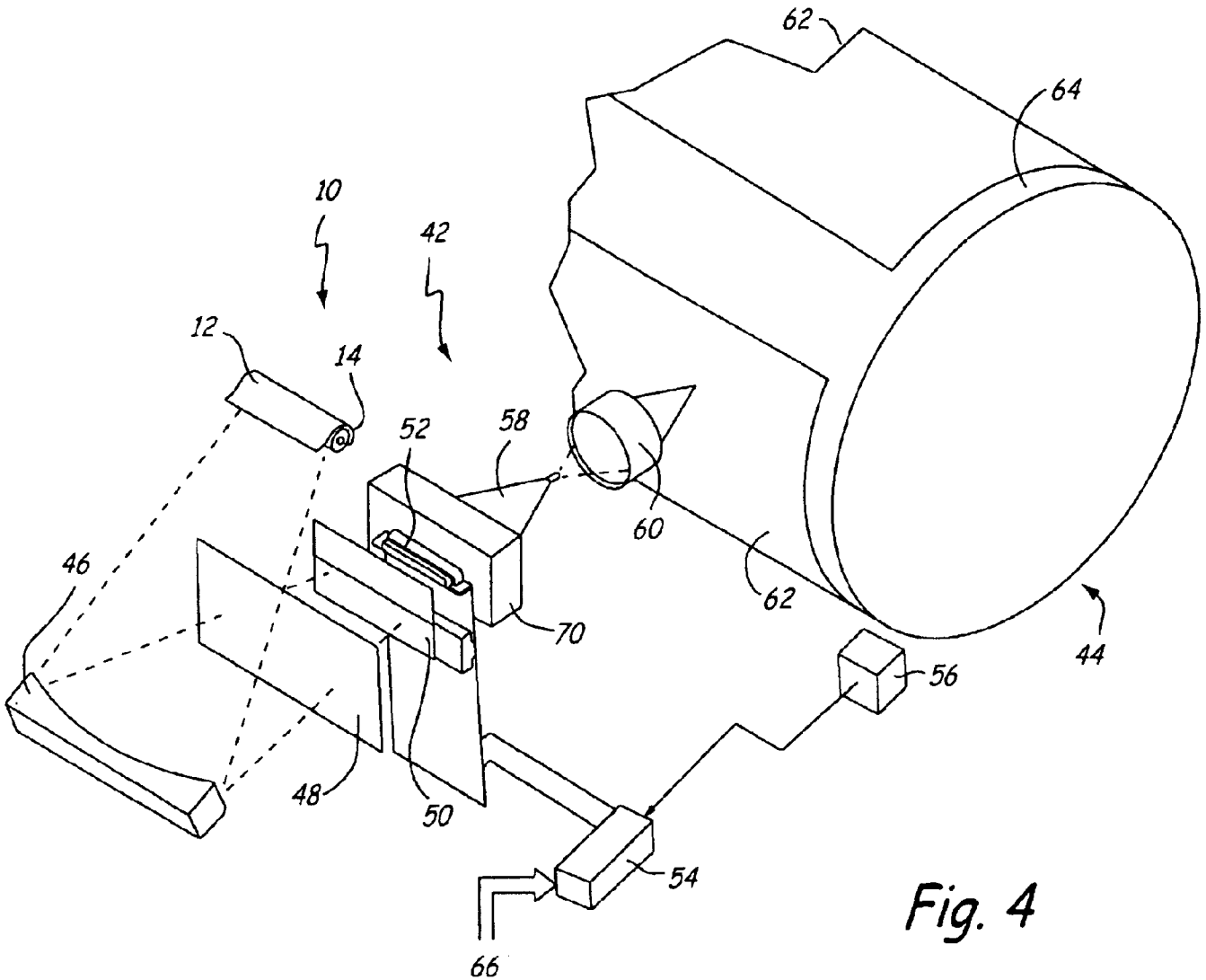
FIG. 4 is an exemplary diagram of the light source assembly used in a first embodiment of the present invention.

FIG. 4 is an exemplary diagram of a first embodiment of a digital imaging system of the present invention. Light source assembly 10 is used in conjunction with modulating system 42 and output system 44. The modulating 42 system comprises parabolic reflector 46, polarizer 48, aperture 50, modulator array 52, driving circuit 54 and encoder 56. The output system 44 comprises focusing light 58, focusing lens 60, light-sensitive medium 62, drum 64 and output fiber assembly 70.

In operation of the first embodiment of the present invention, actinic radiation from light source assembly 10 is focused onto parabolic reflector 46, which is coated to reflect light only in the wavelengths of interest, such as in the 330–430 nanometer (nm) range. Light reflected by parabolic reflector 46 is convergent in two planes, and is directed through optional polarizer 48, which passes only light waves that arc aligned with the polarization angle of polarizer 48. The optionally polarized light impinges on aperture 50, which serves to trim the polarized light to match the input dimensions of modulator array 52, with the non-coherent light preferably being shaped to slightly over-flood the aperture 50. Thus, polarized light passes through aperture 50 as a beam having a width equal to the length of modulator array 52 and having a height equal to the total height of the modulators in modulator array 52, and the divergence of the light is low, preferably less than about 1.5 degrees. The light is thereby apportioned into the plurality of individually controllable modulators contained in modulator array 52. Alternatively, it is within the scope of this invention to include a light-guide (not shown), as is known in the art, to position the modulator 52 further from the light source assembly 10 in the instances where temperature and heat from the light assembly 10 adversely affects modulator 52.

Digital information 66 in the form of a binary image file is utilized by modulator driving circuit 54 to control modulator array 52 and thereby create a selected output light pattern for imaging. The position of drum 64 is provided to modulator driving circuit 54 by encoder 56 in order to synchronize the release of data to modulator array 52 with the position of drum 64, so that the modulation pattern is correlated to the imaging row on light-sensitive medium 62 mounted to drum 64. Output fiber assembly 70 is connected to receive and further transmit the light output from modulator array 52. Each modulator in modulator array 52 refracts or bends the light according to the control signal applied thereto by modulator driving circuit 54. For a first state of the modulator control signal, the light is refracted by an individual modulator at such an angle that the light is not transmitted through fiber assembly 70, but instead passes through the fiber wall and is absorbed and dissipated by the cladding and/or jacket of the fiber therein. For a second state of the modulator control signal, the light is merely passed through the individual modulator, with no more than negligible refraction, and is emitted from an end of fiber assembly 70.

Alternatively, where the divergence of the light is sufficiently consistent, such that the fibers are not required to integrate the power distribution and divergence angles of the light on the light-sensitizable medium 62, fiber assembly 70 may be omitted and a stop plate employed instead, with each modulator being configured so that light is either passed from the modulator or refracted to impinge upon the stop plate. In this manner, light beams are switched "on" (passed through the modulator) or "off" (refracted by the modulator so as to be absorbed and/or dissipated at the output fiber) to create a modulation pattern for imaging on printing plate 62 mounted on drum 64. Final focusing lens 60 is provided to focus the modulated light output from fiber assembly 70 onto light-sensitizable medium 62 for proper exposure thereof.

Focusing lens 60 may be of the relay type, the telecentric type, or the anamorphic type, depending on the imaging requirements as is known in the art. By rotating drum 64 a full revolution, and advancing modulator array 52 horizontally to cover the entire width of medium 62 (with at least one revolution of drum 64 for each position of modulator array 52), the entire expanse of medium 62 can be imaged quickly, and with high resolution. In one embodiment, the horizontal advancement of modulator array 52 can be controlled such that there is partial overlap between horizontal positions, so that the intensity of the output from modulator array 52 can be reduced while still achieving full exposure of medium 62.

Figure 5:
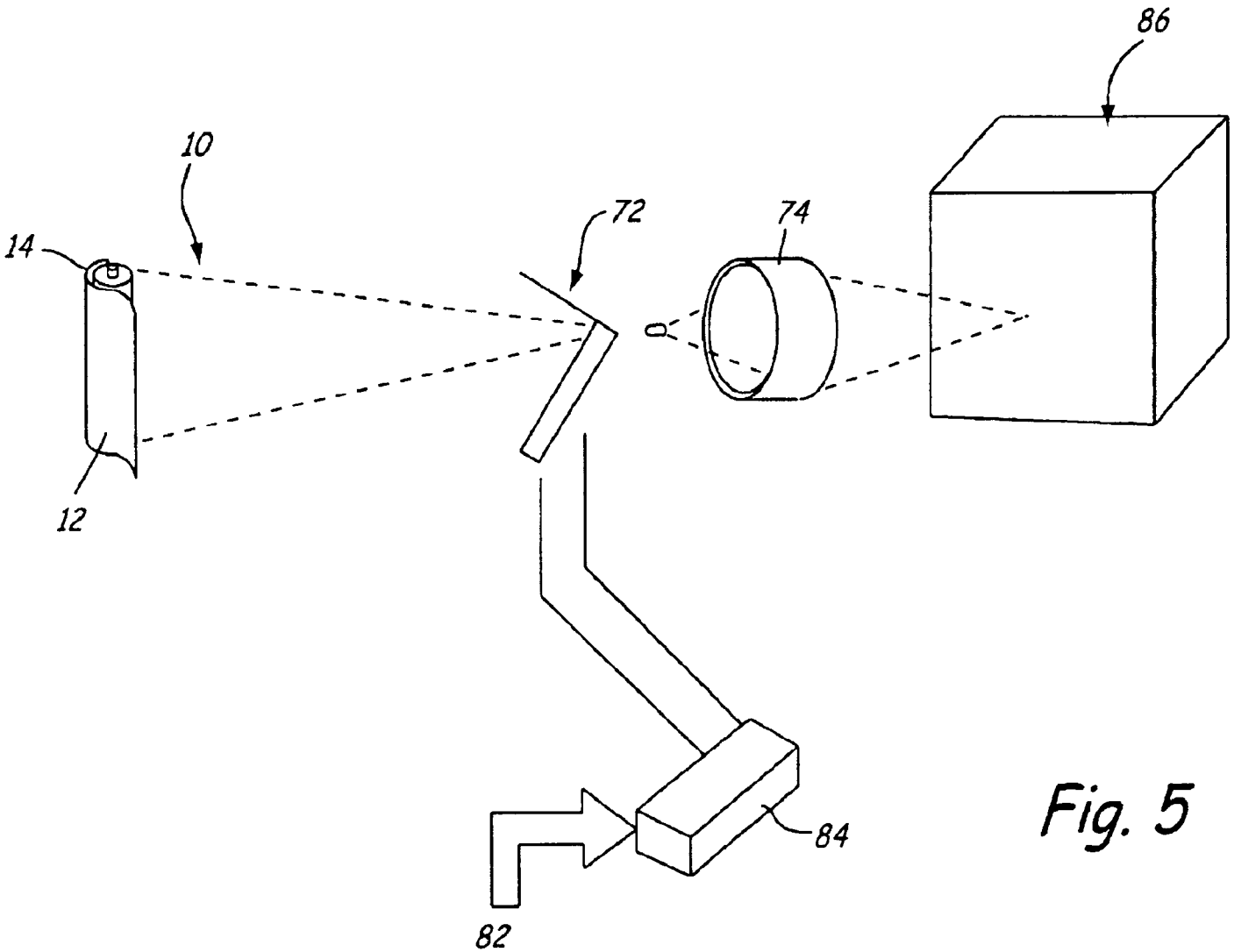
FIG. 5 is a exemplary diagram of the light source assembly used in a second embodiment of the present invention.
Figure 6:
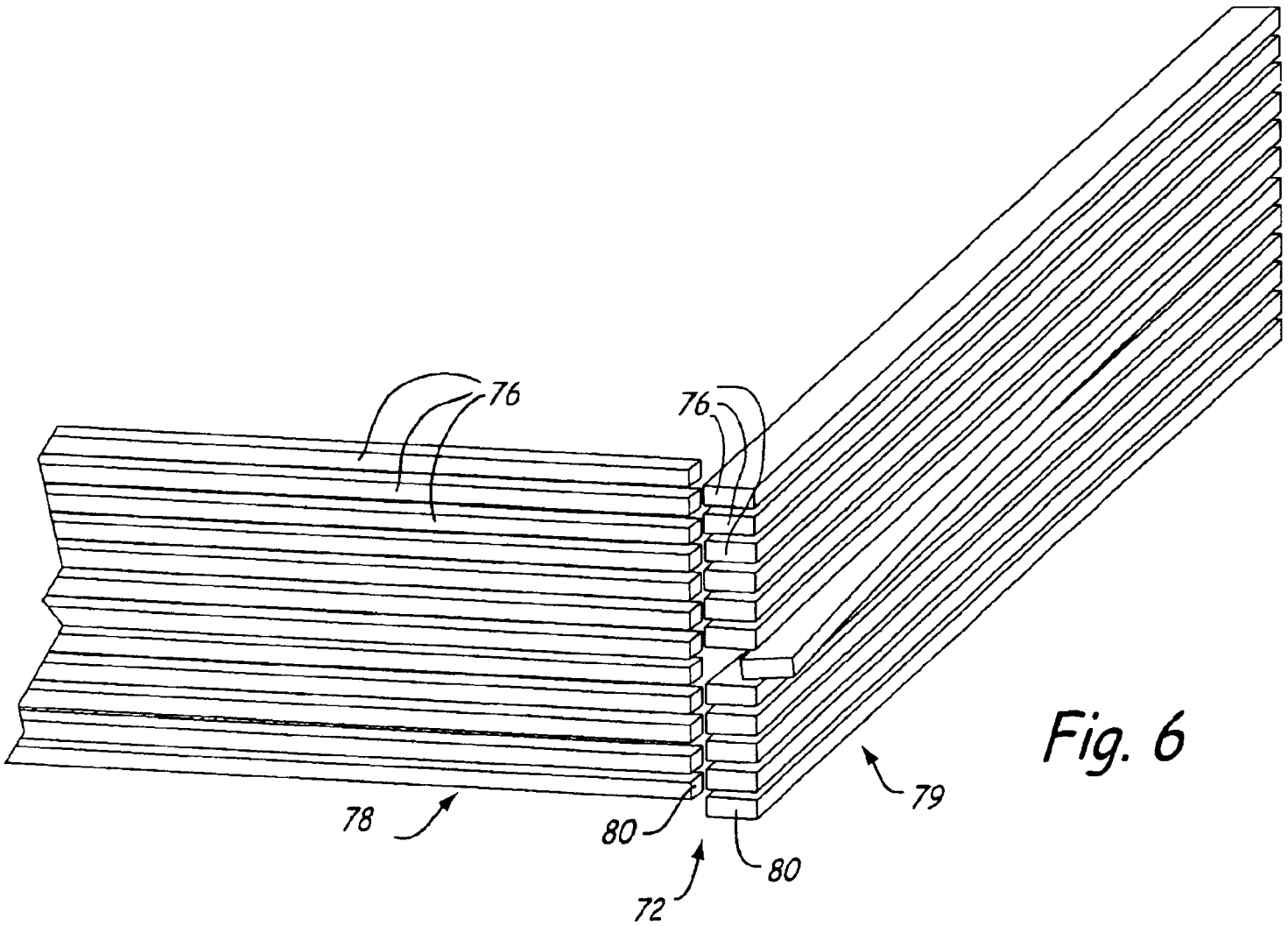
FIG. 6 is a perspective view of a bi-morph comb array of the second embodiment of the present invention.
Figure 7:
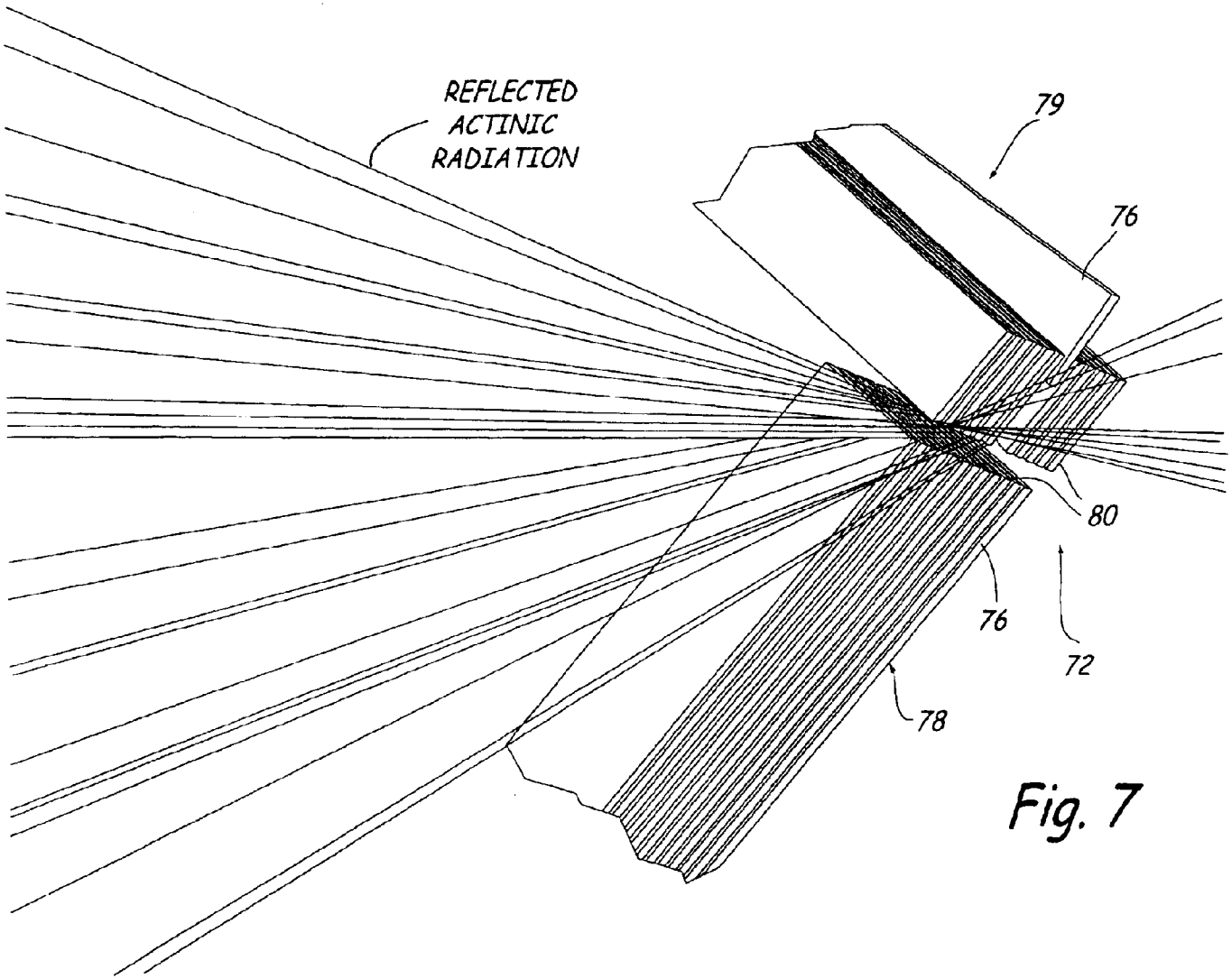
FIG. 7 is a perspective view of a bi-morph comb array of the second embodiment of the present invention.

FIG. 5 is an exemplary diagram of a second embodiment of the present invention. Light source assembly 10 is used in conjunction with a bi-morph comb array 72 and focusing lens 74. Bi-morph comb array 72 is comprised of plurality of bi-morph fingers 76, as is well known in the art, each of which comprises two sheets of piezoelectric polymers with opposite polarities glued together, forming a bending element, or bi-morph. FIG. 6 shows bi-morph comb array 74 in more detail. When a voltage is applied to the bi-morph finger 76, one of the layers elongates, whereas the other contracts, causing the finger 76 to fold or bend. When a voltage with reverse polarity is applied, the bi-morph finger is folded in the opposite direction. Two bi-morph combs, 78 and 79, comprise the array 72 and are positioned at an approximate right angle in relation to each other. Each bi-morph comb, 78 or 79, comprises a group of bi-morph fingers 76 positioned longitudinally adjacent to one another, as is illustrated in FIGS. 6 and 7. The two bi-morphs combs, 78 and 79, of array 72 are positioned in relation to each other such that proximate ends 80 of each finger 76 of one group are abuttably adjacent to a corresponding finger 76 in the other group, with each finger 76 being positioned somewhat off-set from the adjacent finger 76 of the adjacent comb.

Referring now to FIGS. 6 and 7, bi-morph comb array 72 is positioned such that the proximate ends 80 of each bi-morph comb, 78 and 79, are positioned at or near a focal point of imager 10. Thus, in the second embodiment of the present invention, the fingers 76 of bi-morph comb array 72 intersect rays emitted from imager 10. Digital information 82 (FIG. 5) in the form of a binary image file is utilized by circuit 84 (FIG. 5) to control the voltages applied to bi-morph comb array 72. The fingers 76 provide for the obstruction or transmission of the rays to an output system 86 (FIG. 5), such as an output screen or a bundle of fiber optics.

In either aforementioned embodiments, non-coherent light source 14 must satisfy a number of requirements for imager 10 to perform effectively. Light source 14 must provide constant and stable illumination, since any flickering could potentially cause an error in the pixel pattern imaged by the device, creating an improperly exposed pixel due to light source flicker when a "light" (exposed) pixel is desired. Light source 14 also must have a high energy density and provide light having a high degree of collimation. High energy density is required to achieve sufficient power in the light source output at the wavelengths of interest (330–430 nm) within a specified area. so that a light-sensitizable material is effectively exposed by the imaging system.

Finally, a light source 14 must provide light with an intensity sufficient to expose a light-sensitizable medium for imaging, which requires about 0.035 Watts per beam for typical offset printing plates based on a specification of 0.3 Joules per square centimeter at an exposing rate of 30 square centimeters per second. For an exemplary embodiment utilizing an array of 256 modulators to define a line of 256 pixels, about 9 Watts of power are required at the output of the imaging system in the wavelengths of interest (330–430 nm). The specification for typical flexographic printing plates is similar, with 3–5 Joules per square centimeter being required to expose the plate at a rate of 6–7 square centimeters per second. This specification yields a power requirement of about 0.08 Watts per beam, or about 20 Watts of total power provided to a 256-modulator array.

It should be understood that although the present invention has been described with reference to a standard rotating drum imaging system and a bi-morph comb array, the principles of the present invention are equally applicable to other types of imaging systems, such as systems that linearly translate the pre-sensitized medium and systems that employs a reciprocating, scanning imaging head to traverse and expose the medium. Other potential applications of the invention in a number of imaging applications will be apparent to those skilled in the art, and are within the province of the present invention.

Although the present invention has been described with reference to preferred embodiments, workers skilled in the art will recognize that changes may be made in form and detail without departing from the spirit and scope of the invention.

What is claimed is:

1. An apparatus to digitally expose a light-sensitive material comprising:

a non-coherent light source comprising a wall stabilizing plasma-filled capillary;

a reflector positioned proximate the non-coherent light source to reflect actinic radiation;

a modulator positioned to selectively transmit the reflected actinic radiation; and the light sensitive material positioned proximate the modulator to receive modulated actinic radiation.

2. The apparatus of claim 1 wherein the reflector comprises a parabolic shape.

3. The apparatus of claim 2 wherein the reflector further comprises a surface having an ultra-violet dichroic coating for reflecting actinic radiation.

4. The apparatus of claim 1 and further comprising a cooling system for cooling the non-coherent light source.

5. The apparatus of claim 4 wherein the cooling system comprises a cooling tube positioned proximate to and enclosing the non-coherent light source having a fluid flowing through the cooling tube.

6. The apparatus of claim 5 wherein the cooling tube comprises a mirrored surface to reflect light toward the parabolic reflector.

7. The apparatus of claim 1 wherein the non-coherent light source is supplied by direct current.

8. The apparatus of claim 1 wherein the modulator comprises an array having a plurality of fingers configured to selectively obstruct and transmit the actinic radiation in a predetermined radiation pattern to the light sensitive material.

9. The apparatus of claim 8 wherein the array comprises a plurality of bi-morph fingers configured for selective actuation to obstruct and pass the actinic radiation in the predetermined radiation pattern to the light sensitive material.

10. The apparatus of claim 9 wherein the plurality of bi-morph fingers comprises:

a first set of bi-morph fingers positioned longitudinally adjacent to one another, each one of the first set bi-morph fingers defining a pixel of a binary image; and a second set of bi-morph fingers positioned longitudinally adjacent to one another and at an approximate right angle to the first set of bi-morph fingers, each one of the second set of bi-morph fingers defining a pixel of the binary image.

11. A digital imaging system for exposing a light sensitive material, the system comprising:

a non-coherent light source comprising a wall stabilized plasma capillary lamp;

a reflector positioned proximate the non-coherent light source to reflect light produced by the non-coherent light source in a light path;

a modulator array positioned in the light path, the modulator array being pixel addressable to selectively direct light onto the light sensitive material according to a predetermined binary image;

a control circuit operatively coupled to the modulator to control the modulator array to selectively direct the light onto the light sensitive material according to the predetermined binary image; and a lens positioned to focus the selectively direct light onto the light sensitive material.

12. The digital imaging system of claim 11, wherein the reflector is operable to reflect light produced by the non-coherent light source in a focused stripe.

13. The digital imaging system of claim 12, wherein the focused stripe has a height of no greater than about 2 millimeters (mm).

14. The digital imaging system of claim 13, wherein the focused stripe has a length of about 125 mm.

15. The digital imaging system of claim 12, wherein the focused stripe has an energy density of no less than about 1 Watt per square millimeter ($W/mm^2$).

16. The digital imaging system of claim 11, wherein the modulator array comprises a bi-morph comb array having a plurality of bi-morph fingers configured to selectively obstruct and transmit the reflected light from the non-coherent light source to the light sensitive material according to the predetermined binary image.

17. The apparatus of claim 16 wherein the plurality of bi-morph fingers comprises:

a first set of bi-morph fingers positioned longitudinally adjacent to one another, each one of the first set bi-morph fingers defining a pixel of the predetermined binary image; and a second set of bi-morph fingers positioned longitudinally adjacent to one another and at an approximate right angle to the first set of bi-morph fingers, each one of the second set of bi-morph fingers defining a pixel of the predetermined binary image.

18. An apparatus to digitally expose a light-sensitive material comprising:

a non-coherent light source;

an ellipsoidal trough reflector positioned proximate the non-coherent light source to reflect only actinic radiation;

a modulator positioned to selectively transmit the reflected actinic radiation;

the light sensitive material positioned proximate the modulator to receive modulated actinic radiation; and a cooling system for cooling the non-coherent light source comprising a cooling tube positioned proximate to and enclosing the non-coherent light source having a fluid flowing through the cooling tube, and wherein the cooling tube further comprises a mirrored surface to reflect light toward the reflector.

19. The apparatus of claim 18 wherein the non-coherent light source comprises a plasma-filled capillary.

20. The apparatus of claim 19 wherein the capillary is wall stabilized.

21. The apparatus of claim 18 wherein the reflector further comprises a surface having an ultra-violet dichroic coating for reflecting the actinic radiation.

22. The apparatus of claim 18 wherein the non-coherent light source is supplied by direct current.

23. The apparatus of claim 18 wherein the modulator comprises an array having a plurality of fingers configured to selectively obstruct and transmit the actinic radiation in a predetermined radiation pattern to the light sensitive material.

24. The apparatus of claim 23 wherein the array comprises a plurality of bi-morph fingers configured for selective actuation to obstruct and pass the actinic radiation in the predetermined radiation pattern to the light sensitive material.

25. The apparatus of claim 24 wherein the plurality of bi-morph fingers comprises:

a first set of bi-morph fingers positioned longitudinally adjacent to one another, each one of the first set of bi-morph fingers defining a pixel of a binary image; and a second set of bi-morph fingers positioned longitudinally adjacent to one another and at an approximate right angle to the first set of bi-morph fingers, each one of the second set of bi-morph fingers defining a pixel of the binary image.

26. A digital imaging system for exposing a light sensitive material, the system comprising:

a non-coherent light source;

a reflector positioned around at least a portion of the non-coherent light source to reflect only ultraviolet light produced by the non-coherent light source in a light path wherein the reflector is operable to reflect ultraviolet light produced by the non-coherent light source is a focused stripe and wherein the focused stripe has an energy density of no less than 1 Watt per square millimeter ($W/mm^2$);

a modulator array positioned in the light path, the modulator array being pixel addressable to selectively direct the ultraviolet light onto the light sensitive material according to a predetermined binary image;

a control circuit operatively coupled to the modulator array to control the modulator array to selectively direct the ultraviolet light onto the light sensitive material according to the predetermined binary image; and a lens positioned to focus the selectively directed ultraviolet light onto the light sensitive material.

27. The digital imaging system of claim 26, wherein the focused stripe has a height of no greater than about 2 millimeters (mm).

28. The digital imaging system of claim 27, wherein the focused stripe has a length of about 125 mm.

29. The digital imaging system of claim 26, wherein the modulator array comprises a bi-morph comb array having a plurality of bi-morph fingers configured to selectively obstruct and transmit the reflected ultraviolet light from the non-coherent light source to the light sensitive material according to the predetermined binary image.

30. The apparatus of claim 29 wherein the plurality of bi-morph fingers comprises:

a first set of bi-morph fingers positioned longitudinally adjacent to one another, each one of the first set bi-morph fingers defining a pixel of the predetermined binary image; and a second set of bi-morph fingers positioned longitudinally adjacent to one another and at an approximate right angles to the first set of bi-morph fingers, each one of the second set of bi-morph fingers defining a pixel of the predetermined binary image.

* * * * *

UNITED STATES PATENT AND TRADEMARK OFFICE

CERTIFICATE OF CORRECTION

PATENT NO. : 6,700,598 B1
DATED : March 2, 2004
INVENTOR(S) : Frank A. Hull

It is certified that error appears in the above-identified patent and that said Letters Patent is hereby corrected as shown below:

Column 1,
Line 57, delete “of”, insert -- or --
Line 60, delete “Kerr-cell”, insert -- Kerr-cells --

Column 3,
Line 16, delete “severe”, insert -- sever --
Line 62, delete “arc”, insert -- are --

Column 4,
Line 56, after “quickly,”, insert -- efficiently --

Column 5,
Line 5, delete “bi-morphs”, insert -- bi-morph --
Line 44, after “Finally,”, delete “a”

Signed and Sealed this

Fifth Day of July, 2005

JON W. DUDAS
*Director of the United States Patent and Trademark Office*